US007712190B2

(12) United States Patent
Weingartner

(10) Patent No.: US 7,712,190 B2
(45) Date of Patent: May 11, 2010

(54) CLIP FOR CLIPPING SHEETS TOGETHER

(76) Inventor: Peter Weingartner, Redtenbachergasse 56/33, Wien (AT) A-1160

( * ) Notice: Subject to any disclaimer, the term of this patent is extended or adjusted under 35 U.S.C. 154(b) by 399 days.

(21) Appl. No.: 10/550,478

(22) PCT Filed: Feb. 18, 2004

(86) PCT No.: PCT/AT2004/000047

§ 371 (c)(1),
(2), (4) Date: Aug. 7, 2006

(87) PCT Pub. No.: WO2004/085170

PCT Pub. Date: Oct. 7, 2004

(65) Prior Publication Data

US 2006/0277725 A1 Dec. 14, 2006

(30) Foreign Application Priority Data

Mar. 24, 2003 (AT) ..... A 465/2003

(51) Int. Cl.
*B42F 1/00* (2006.01)
*B42F 1/04* (2006.01)
*B42F 1/10* (2006.01)
*B42F 1/12* (2006.01)

(52) U.S. Cl. ..... 24/67.9; 24/67.3; 24/67 R; 24/DIG. 8; 24/DIG. 9; 24/67 CF

(58) Field of Classification Search ..... 24/67 R, 24/67 CF, 545, 67.3–67.11, 546, 556, 560, 24/564, 566, 570, 571, 30.5 R, 535, 462, 24/DIG. 8, DIG. 9; 402/8, 19, 73, 79, 80 R; 206/453; 229/198.1, 198.2, 198.3, 199, 199.1; 40/8, 19, 73, 79, 80 R
See application file for complete search history.

(56) References Cited

U.S. PATENT DOCUMENTS 658,965 A * 10/1900 Senna ..... 24/55
1,019,256 A * 3/1912 Irving ..... 24/555
1,038,164 A * 9/1912 Lobb ..... 30/174
1,070,683 A * 8/1913 Hale ..... 24/563
1,148,934 A * 8/1915 Shuey ..... 24/563

(Continued)

FOREIGN PATENT DOCUMENTS

| | | |
|---|---|---|
| EP | 1074401 A1 | 2/2001 |
| FR | 2549706 | 2/1985 |
| FR | 2691106 | 5/1992 |
| FR | 2691106 | 11/1993 |
| GB | 157520 | 1/1921 |
| GB | 2017586 | 10/1979 |
| WO | WO03/010009 | 2/2003 |

*Primary Examiner*—Robert J Sandy
(74) *Attorney, Agent, or Firm*—Kolisch Hartwell, P.C.

(57) ABSTRACT

The invention relates to a clip for clipping together sheets which are made of paper, plastic, metal etc, on the corners or sides thereof. Said clip is U-shaped and comprises two similar or different limps. The stack of paper is clipped together between said two limps or by means of projections incorporated therein. The invention is characterised in that said clip is embodied as a triangular single piece or is trapezium-shaped or is shaped like a semi-circle or is semi-elliptically shapes with limpbs (1, 1*a* or 1*b*) which are arranged parallel to each other when in the rest position. The two limbs (1, 1*a* or 1*b*) comprise a small fold (3), which is inwardly curved an which bends to form an acute or obtuse angle (3*a*), on each side (4) forming an acute angle or an obtuse angle (4*a*) with the back (2) or on each vertex (8). The two limbs (6) are arranged on top of each, parallel to each other and are connected together without mutual contact by means of a spring (7) both in a rest position and also in a position wherein a stack of sheets is clipped. The clip is displaced in the direction of the edge (4) or the back (2) on the stack of paper and is clipped by the pre-tensed back (2) or the spring (7) on the folds (3) which are inwardly curved.

6 Claims, 2 Drawing Sheets

U.S. PATENT DOCUMENTS 1,205,889 A * 11/1916 Halvorson ..... 24/556
1,423,520 A * 7/1922 Freedman ..... 24/67 R
1,590,682 A * 6/1926 Hart ..... 24/30.5 R
1,899,753 A 11/1931 Felsenthal
2,310,835 A * 2/1943 Burleigh et al. ..... 24/67.3
2,498,066 A * 2/1950 Challinor ..... 132/284
2,797,886 A * 7/1957 Pinckney ..... 248/113
3,604,425 A * 9/1971 Le Roy ..... 606/158
3,766,613 A * 10/1973 Merfeld ..... 24/561
3,837,133 A * 9/1974 Mollman ..... 52/489.2
4,324,025 A 4/1982 Apri
4,946,065 A * 8/1990 Goulter et al. ..... 24/545
5,104,088 A * 4/1992 Bakanowsky, III ..... 248/442.2
5,309,605 A 5/1994 Sato
5,357,635 A * 10/1994 Lemoine ..... 2/84
5,432,982 A * 7/1995 Van Ardenne-
Van Rhijn ..... 24/67.9
D381,361 S * 7/1997 Sato ..... D19/65
5,682,650 A * 11/1997 Noguchi et al. ..... 24/67.3
5,791,024 A 8/1998 Jovanovich
5,865,469 A * 2/1999 Chin ..... 402/79
5,970,586 A * 10/1999 Demel et al. ..... 24/555
6,018,849 A 2/2000 Royer
6,663,311 B1 * 12/2003 Ong ..... 402/19
6,725,508 B1 * 4/2004 Noda et al. ..... 24/545
2004/0117957 A1 * 6/2004 Kintzing et al. ..... 24/545

* cited by examiner

X-X

CLIP FOR CLIPPING SHEETS TOGETHER

This invention concerns a clip for clamping sheets according to the preamble of claim 1. There are several kinds of clips of differently designs in principle:

On the one hand staples, which perforate the paper and which can only be removed with difficulty and on the other hand clips based on friction, which can in turn essentially be divided into two groups, i.e.: paper clips consisting of a piece of wire, plastic or sheet metal or spring-loaded clamping devices with attached handles.

In the case of the conventional paper clip and the sheet metal clamp, the latter group of clips, which are based on a clamping effect, have the disadvantage of low holding ability, while, due to the necessary handles, the other devices are cumbersome, multipart and bulky and also of only limited functionality, since the closing and opening mechanism is not separated from the clipping mechanism.

The one-piece clips of WO 2001/58700A, DE 42 39 544A, U.S. Pat. No. 5,970,777A, GB 1 206 538A, DE 381 81° C. have two faults:

1. Those, which can be easily slipped onto a stack of sheets, only have low clamping power due to the material or because they clamp by means of surfaces.
2. The only clip with high clamping power (WO 01/58700A) is however very difficult to remove from the stack.

This invention aims to provide remedial measures and to disclose a clip wherewith the sheets that are to be held together are pressed directly against each other and are fixed, without damaging the sheets, by means of spring-loaded triangular or trapezoidal or semicircular or semielliptical limbs and by inwardly bent folds. The clamping effect of this clip is almost comparable with that of a positive locking clip. According to this invention, these goals are achieved by means of the technical features characterized in claims 1 to 3.

The invention is described in greater detail in the following by means of the drawings.

FIG. 1 shows this clip in horizontal projection, FIG. 2 in lateral projection and FIG. 3 in oblique projection.

The clip, as represented in FIGS. 1-6, has two mirror-image limbs 1, 1*a*, 1*b*, which are connected with each other so as to swivel elastically along a back 2. Since the clip is intended to grasp the paper stack on one corner and since the stack must be easily separable, the limbs 1, 1*a*, 1*b* are made to be triangular or trapezoidal or semicircular or semielliptical.

Figure 7:
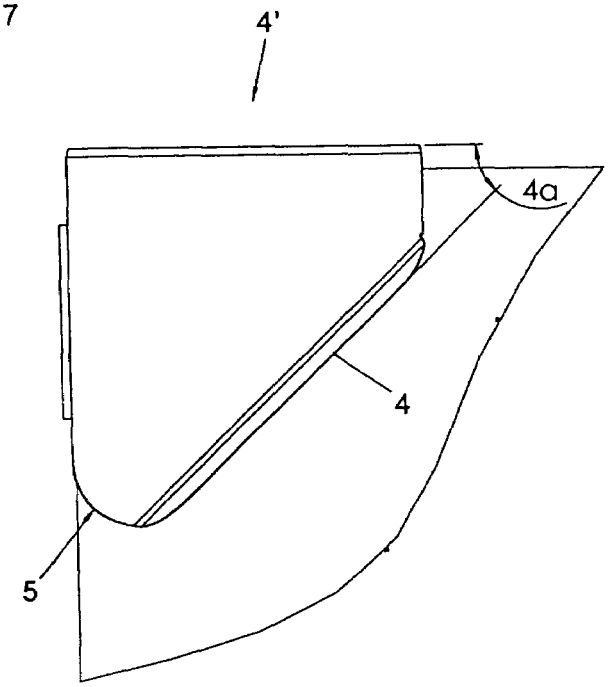
FIGS. 7-9 show a multipart clip of this invention, whose limbs are almost identical with that of FIGS. 1-3.
Figure 8:
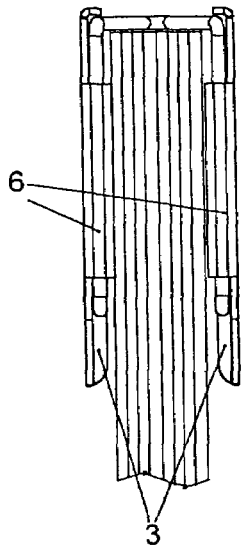
Figure 9:
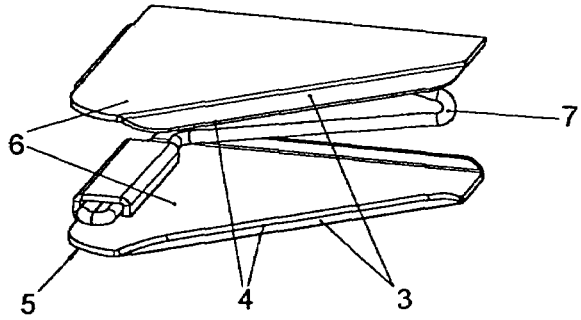

The clip, as shown in FIG. 7-9 has two limbs 6, which are movably connected with one another by a spring 7 such that, both in the relaxed state of the clip and in the state in which a stack of sheets is clamped, both limbs 6 are located on top of each other and parallel to each other, without mutual contact.

Figure 1:
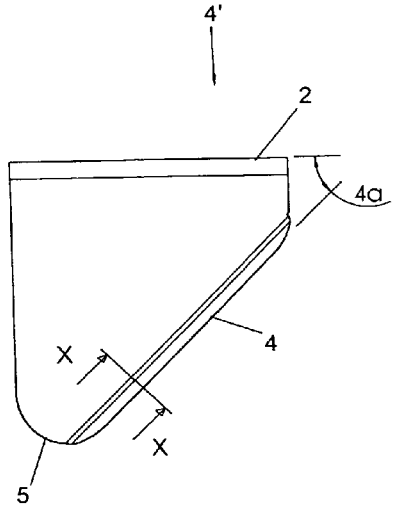
FIGS. 1-3 show a triangular form of a one-piece clip of this invention.
Figure 2:
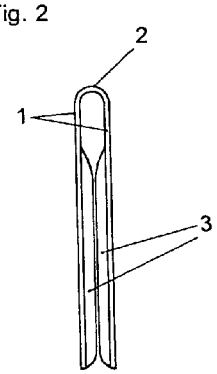
Figure 3:
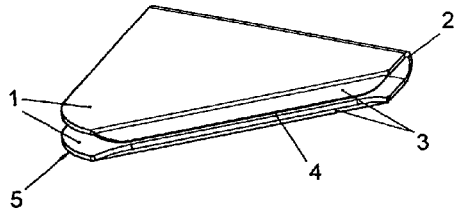
Figure 1A:
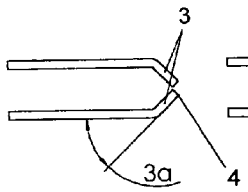
Figure 1B:
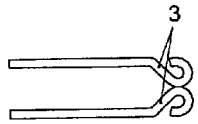
Figure 4:
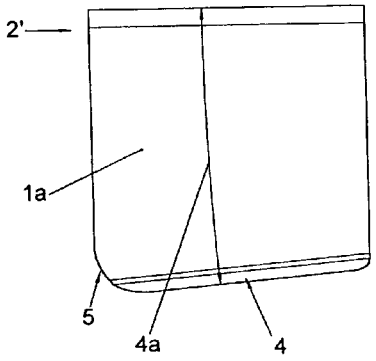
FIGS. 4-6 show a trapezoidal and semicircular design of the clips of FIGS. 1-3.
Figure 5:
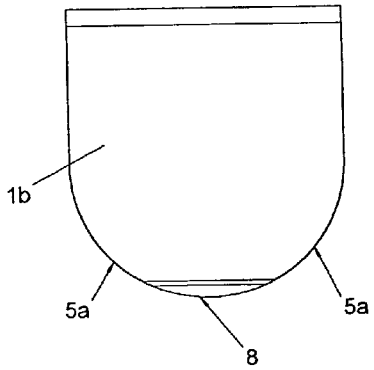
Figure 6:
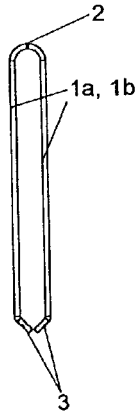

As shown in FIG. 1A and FIG. 1B, the inwardly curved folds 3 are respectively located on one side 4 of the two limbs 1, 1*a*, 6 (FIGS. 1, 4, 7) arranged at an acute or obtuse angle 4*a* with respect to the back 2 or in the region of the vertex 8 of the two limbs 1*b* (FIG. 5). The clip is neither opened nor closed, it is only applied to the paper stack with the curve 5 of the limbs 1, 1*a*, 6 or with the curve 5*a* of the limbs 1*b* and pushed over the paper stack by finger pressure 4', 2' in the direction of the edge 4 or toward the back 2. It is removed by pushing in the direction opposite to 4' or 2'.

An absolutely reliable stop of the clamped sheets is ensured by the fold 3 which is beveled at an angle 3*a*. This clip can be made of metal, plastic, wood or paper.

The invention claimed is:

1. A clip for clamping sheets of paper, plastic, metal, and other materials at the sheet corners or sides, the clip comprising:

two limbs (1, 1*a*, 1*b*); and a pre-tensioned back (2) configured to apply a force to the limbs;

where the clip is configured to be U-shaped with the limbs parallel to each other in a relaxed state; each limb including a small inward fold (3) of less than 90 degrees (3*a*), each inward fold defining a fold line; the fold lines being parallel to each other and disposed at an acute angle (4*a*) with respect to the back; the clip is configured so that the sheets may be clamped between the limbs by virtue of the force applied by the pre-tensioned back; and the clip comprises metal or high-strength plastic or wood or compressed cellulose.

2. Clip according to claim 1, characterized by the fact that, both in the relaxed state of the clip and in a state with a clamped stack of sheets, both limbs (6) are arranged on top of each other and parallel to each other by means of a spring (7).

3. Clip according to claim 1, characterized by the fact that it is made to be multipart, with both limbs (6) being connected by means of a spring (7) without making mutual contact.

4. Clip, according to claim 1, characterized by the fact that sheets may be clamped between the limbs by virtue of the force applied by the pre-tensioned back in combination with projections incorporated into the limbs.

5. Clip according to claim 1, characterized by the fact that the clip is made to be multipart.

6. Clip according to claim 1, characterized by the fact that each limb is triangular, trapezoidal, semicircular, or semielliptical.

* * * * *